US008573013B2

(12) United States Patent
Hug et al.

(10) Patent No.: US 8,573,013 B2
(45) Date of Patent: Nov. 5, 2013

(54) METHOD AND DEVICE FOR ADJUSTING A FLEXER STATION DURING THE ROUNDING OF METAL SHEETS

(75) Inventors: Peter Hug, Fischbach-Göslikon (CH); Daniel Dieterich, Hittnau (CH)

(73) Assignee: Soudronic AG, Bergdietikon (CH)

( * ) Notice: Subject to any disclaimer, the term of this patent is extended or adjusted under 35 U.S.C. 154(b) by 771 days.

(21) Appl. No.: 12/601,883

(22) PCT Filed: Apr. 17, 2008

(86) PCT No.: PCT/CH2008/000174

§ 371 (c)(1), (2), (4) Date: Nov. 25, 2009

(87) PCT Pub. No.: WO2008/144947

PCT Pub. Date: Dec. 4, 2008

(65) Prior Publication Data

US 2010/0154499 A1 Jun. 24, 2010

(30) Foreign Application Priority Data

May 30, 2007 (CH) ..... 0862/07

(51) Int. Cl.
*B21B 39/02* (2006.01)
*B21B 37/72* (2006.01)

(52) U.S. Cl.
USPC ..... 72/133; 72/7.5; 72/8.8; 72/11.5

(58) Field of Classification Search
USPC ..... 72/3, 4, 7.5, 8.8, 11.5, 12.5, 133, 250, 72/251, 419, 420, 428
See application file for complete search history.

(56) References Cited

U.S. PATENT DOCUMENTS 4,870,241 A 9/1989 Gysi
5,209,625 A 5/1993 Stieger
2008/0098784 A1* 5/2008 Hartung et al. ..... 72/160

FOREIGN PATENT DOCUMENTS

GB 2 126 132 A 3/1984

OTHER PUBLICATIONS

International Search Report forPCT/CH2008/000174, Oct. 13, 2008.

* cited by examiner

*Primary Examiner* — Dana Ross
*Assistant Examiner* — Lawrence Averick
(74) *Attorney, Agent, or Firm* — McCormick, Paulding & Huber LLP

(57) ABSTRACT

During the bending of sheet metal sections (1, 2) in particular for forming can edges using a bending machine, the sheet metal is pre-treated at a flexing station (50) before reaching the bending station. The contact position (x, y, y') of a sheet on a measuring plate (38) is measured and the signal representing the contact position is reproduced on a display (25), enabling the operator to adjust at least one element (7, 8, 9, 20) of the flexing station in accordance with the deviation of the actual contact position from the target contact position, either manually or by means of a drive. The signal can also be used to automatically adjust at least one element of the flexing station.

7 Claims, 2 Drawing Sheets

METHOD AND DEVICE FOR ADJUSTING A FLEXER STATION DURING THE ROUNDING OF METAL SHEETS

CROSS REFERENCE TO RELATED APPLICATIONS

This application claims the priority of Swiss patent application no. 00862/07, which was filed on May 30, 2007 and PCT application no. PCT/CH2008/000174, which was filed Apr. 17, 2008 and of which the entire disclosures are hereby included by reference.

BACKGROUND OF THE INVENTION

The invention is related to a method for adjusting a flexer station for the pre-treatment of metal sheets before their rounding, wherein inside of the flexer station a target impact position of the metal sheet on a measurement plate serves as a reference for the adjustment of at least an adjustable element of the flexer station. Furthermore, the invention is related to a use of the method for welding can bodies. Furthermore, the invention is related to a flexer station with at least an adjustable flexer element. Furthermore, the invention is related to a rounding apparatus with such a flexer station and a welding device for manufacturing can bodies with such a rounding apparatus.

PRIOR ART

When rounding metal sheets for forming container body blanks it is known to arrange a so-called flexer station ahead of the actual rounding elements of the rounding apparatus. Inside of it, a pre-rounding of each metal sheet takes place, which however is undone for the most part in the flexer station. By this bending and bending back or pre-rounding and rounding back respectively tensions in the metal sheets, which could affect the result during the actual rounding in the rounding machine are eliminated. However, the front area of the metal sheets in transport direction is normally not being rounded back but it keeps the pre-rounding from the flexer station in order to improve the rounding result of the rounding apparatus. In U.S. Pat. No. 5,209,625, such a pre-rounding machine or flexer station with rollers 16 and 17 and a pre-rounding element 21 respectively, are shown, wherein a table 20 with a cover 22 undoes the pre-rounding, except in the area of the front edge of the metal sheet in transport direction. However, it is also known—and subsequently also shown in this way—that a flexer wedge takes over the back-bending after the pre-rounding. According to the prior art, the initial adjustment of the flexer station, and thereby particularly of the flexer wedge, takes place manually. A test metal sheet is transported through the flexer station by manually rotating the whole rounding apparatus and has to impact a plate in a certain area. If this is not the case, the position of the flexer wedge has to be changed. This operation possibly has to be repeated several times until the correct adjustment is found or the correct pre-rounding for the subsequent rounding station of the rounding apparatus respectively, is reached. During the adjustment of the flexer wedge, screws have to be released, which may partly be difficult to reach and most of the times rounding wedges have to be removed as well, such that the impact position of the metal sheet on the measurement plate is well viewable.

Methods and devices of said type are generally used in the metal sheet processing industry during the rounding of metal sheets, particularly during the production of container bodies, particularly can bodies, of metal sheet. For this, after the rounding, the container body blanks are transported directly into a welding machine for welding the longitudinal seam of the body. Thereby, the destacking of the metal sheets, the rounding apparatus and the welding machine normally form an entity. Corresponding systems for the production of cans are for example known from DE-A-33 30 171 or from said U.S. Pat. No. 5,209,625. There, the rounding takes place in such a way, that the formed can body can be guided directly into the Z-rail used for the seam overlapping. For the rounding, the metal sheet sections which are cut rectangularly with defined dimensions and material characteristics recorded in standards, are pushed by a feeding system into a first, actuated transport roller pair, are transported further by multiple actuated transport rollers with a speed of 100-450 m/min. and are bent to a round body inside of a rounding apparatus with a rounding system, by means of wedges with rollers or with roller systems. As explained, a plastic deformation takes place in advance by means of the elements of a flexer station.

SUMMARY OF THE INVENTION

It is the task of the invention to avoid the mentioned disadvantages during the adjustment of a flexer station.

This is attained by the method mentioned in the beginning by determining the impact position of a test metal sheet on the measurement plate during the motor-driven passage of the metal sheet through the flexer station by means of a sensor arrangement, by means of which a signal showing the impact position is provided, wherein the impact position or a value derived from it is shown on a display device and/or wherein an element of the flexer station defining its pre-rounding is adjusted by means of its controller and an actuator in such a way, that a deviation from the target impact position is diminished.

By means of the approach according to the invention, the manual transporting of the metal sheet through the rounding apparatus or the flexer station respectively is obsolete because the impact position is determined by the sensor arrangement during the motor-driven operation. The real impact position or the actual impact position respectively, onto the measurement plate may be shown on a display device, wherein the target position is preferably shown as well. By means of the information of the impact position, the operator may manually adjust an adjustable element of the flexer station in such a way, that the deviation from the target impact position is smaller and as much as possible null. Thereby, the mentioned representation of the target impact position on the display may be helpful. The target impact position is known according to the prior art and depends on the metal sheet to be rounded and on the rounding speed. Instead of the impact position, a signal derived therefrom may be shown, for example directly a numerical value for the adjustment of an adjustable element of the flexer station. Additionally or alternatively to the display, an automatic adjustment of an element of the flexer station determining the pre-treatment by means of the latter may take place by means of the signal showing the impact position. In any case, the result is a lower expenditure of time because the impact position does not have to be determined by the operator visually on the measurement plate itself and the detaching of rounding elements (wedges) necessary for this is avoided.

The method for the adjustment of the flexer station is preferably used during the rounding of container bodies for their welding on resistance seam welding machines, wherein single metal sheet sections run through the flexer station and the rounding station and then the welding device serially with a high speed of 100-450 m/Min. Accordingly, the adjustment also takes place because of an impact position which was determined with the speed corresponding to the later speed during the rounding in the series production.

In the cases of the embodiments mentioned at the beginning, the task is solved in such a way, that the flexer station has a sensor arrangement and a controller, by means of which the impact position of the test metal sheet onto the measurement plate is ascertainable by means of the flexer station during the motor-driven passage of the metal sheet, by means of which a signal showing the position is provided, by means of which the impact position or a value derived therefrom is presentable on a display device, and/or by means of which an element of the flexer station determining the pre-treatment of the metal sheets is adjustable by means of the controller and of an actuator in such a way, that a deviation from the target impact position is diminished.

Thereby, the advantages explained by means of the method are resulting.

The invention is further related to a rounding apparatus with such a flexer station, as well as a welding device for container bodies with such a rounding apparatus.

The rounding apparatus or the rounding machine respectively, for the manufacturing of container body blanks is, particularly for the forming of can body blanks, equipped for rounding with a speed of 100 to 450 m/minute. The rounded container body blanks are fed out of the rounding machine into a welding device for can bodies with welding rollers, particularly with intermediary wire electrodes running on it, and a Z-rail for the positioning of the body edges. Accordingly, the measurement of the impact position takes place with a passage speed in the area of 100 to 450 m/min. in order to determine the impact position during operation speed. A flexer wedge following the flexer rollers is preferably adjusted as adjustable flexer element because of the signal. The measurement of the impact position takes place preferably electrically by means of electric contact establishment on the measurement plate by means of the impacting metal sheet.

BRIEF DESCRIPTION OF THE DRAWINGS

Further embodiments, advantages and applications of the invention result from the dependent claims and from the now following description by means of the figures.

DESCRIPTION OF THE PREFERRED EMBODIMENTS

Figure 1:
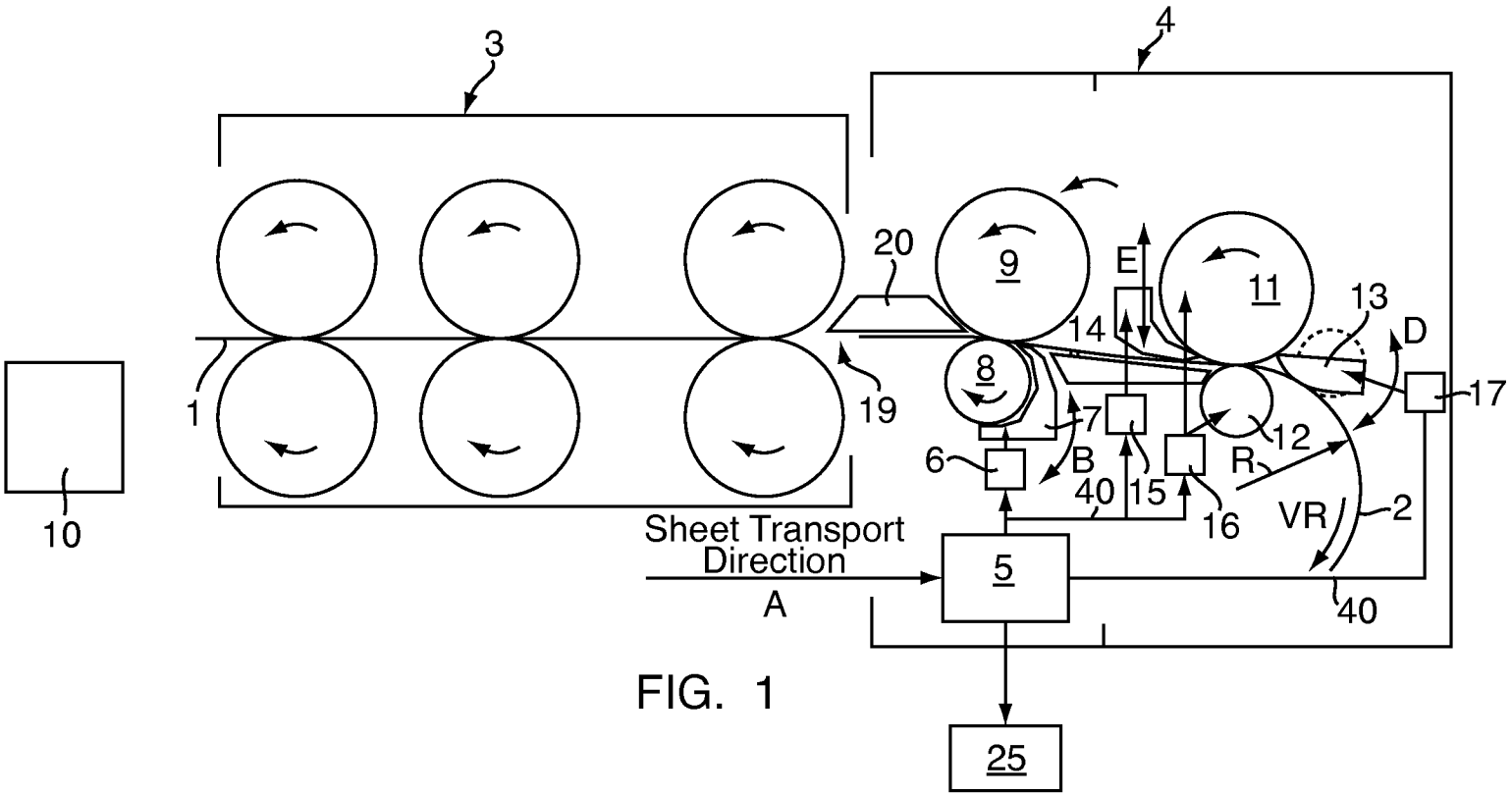
FIG. 1 schematically shows a device for rounding container bodies by means of a flexer station.
Figure 2:
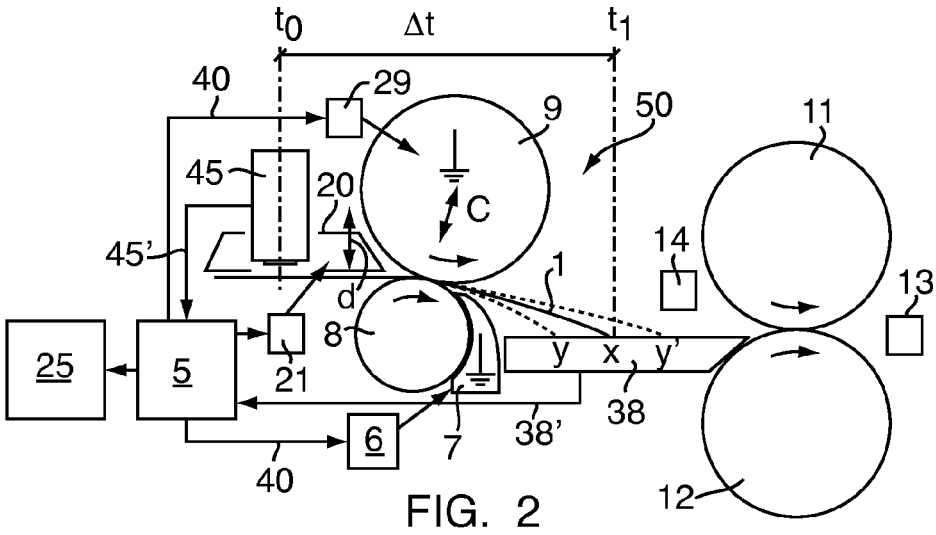
FIG. 2 schematically shows a flexer station for the explanation of further embodiments of the invention.

FIG. 1 and FIG. 2 show schematically in a side view embodiments of the present invention, wherein the adjustment of a flexer station in a rounding machine for the rounding of subsequent metal sheet sections is shown as an example, as it is used during the series production of container body blanks or during the welding of container blanks, particularly can bodies, respectively. However, the invention may also be used for the adjustment of flexer stations during arbitrary different rounding processes or rounding machines respectively.

In the shown example it is evident that metal sheet sections, of which the sections 1 and 2 are represented as examples, are destacked from a stack 10 and fed into a transport installation 3, which serves as feeding path for a rounding machine 4 comprising the flexer station. Thereby, the metal sheets traverse this arrangement of feeding path and rounding machine in the direction of the arrow A. The destacking from the stack 10 and the bringing in into the transport installation 3 is not being explained here, as it is known to the skilled person. The transport installation 3 is furthermore to be seen as facultative, even though preferred, such that the metal sheets may also be passed directly from the stack 10 into the rounding machine 4. In the shown embodiment, the transport installation 3 is equipped with a plurality of roller pairs which convey the respective metal sheet section to the entrance 19 of the rounding apparatus 4, where, in this example, the flexer station 50 starts with a first element 20. The conveying may also be executed in a different way than with the shown roller pairs. In the rounding apparatus or in the rounding machine 4 respectively, each metal sheet section is rounded to a body blank, as it is evident for the front part, in feed direction, of the metal sheet section 2. Thereby, the rounding takes place with a nominal rounding diameter, predefined by the setting of the rounding machine, and leads to the rounding diameter R; this with a rounding speed VR of for example 100 to 450 m/minute, particularly when rounding can body blanks. Rounding machines are known in various embodiments, also particularly for can bodies, whereby the rounding machine may be provided in a simple form as two-roller rounding machine with the two rollers 11 and 12. Equally, rounding machines with a plurality of rollers are known, such for example from EP-A-1 197 272. Preferably, the rounding apparatus is controllable in its adjustment for determining the rounding in the rounding operation. In the present embodiment it is shown that a pre-rounding wedge 14 may be provided ahead of the rounding rollers 11 and 12. Equally, a rounding wedge 13 may be provided after the rounding rollers 11, 12. The flexer station 50 is provided ahead of the actual rounding station of the rounding apparatus 4, which is a part of the rounding apparatus in the shown embodiment, which however may also be a separate station. In the shown example, the flexer station has the rollers 9 and 8 as well as the flexer wedge 7 which acts upon the metal sheet coming out of the rollers, as well as the mentioned wedge 20 at the entrance of the flexer station. The flexer station serves for the pre-treatment and for the removal of tensions in the metal sheet as explained, and is for example known from the aforementioned U.S. Pat. No. 5,209,625.

Thereby, at least an element of the flexer station is adjustable for the sake of its adaptation, to the metal sheet material to be rounded and to the rounding speed, which is known, wherein the adjustment takes place before the actual rounding operation or in the case of container bodies before their series production respectively. This element may be manually adjustable, as known, or an adjustable motor-driven adjustment may be provided. The adjustment of the mentioned flexer wedge is preferred. The preferably actuated adjustable element or elements of the flexer station, and if necessary the rounding elements of the rounding machine as well, are provided with drives (subsequently called actuators), which can move these elements, within the scope of their ordinary adjustment capabilities, in order to allow the adjustment to the controller of the flexer station; the influence of the actuators on the elements of the flexer station and, as far as provided, also on the elements of the rounding machine, is symbolized in the figures by an arrow starting at the actuator and ending in the respective element, the motion of the element by another arrow. The connection of the actuators with the controller 5 is symbolized by lines 40. In this way, the flexer wedge 7 can be moved by actuator 6 in the direction of the arrow B. This also corresponds to the manual adjustability of the flexer wedge, if no actuator is provided for the adjustment. As far as an adjustment of the flexer roller 9 is provided, according to FIG. 2, it takes place by means of an actuator 29 in the direction of the arrow C, or at most manually in a corresponding way. If an adjustment of the wedge 20 of the flexer station is provided, it takes place by means of the actuator 21 in the direction of the arrow d, or accordingly manually. In the rounding station the pre-rounding wedge 14 may be moved by the actuator 15 in the direction of the arrow E. For the rollers 11 and 12, a drive determining their mutual distance may be provided, which acts upon one or upon both of the rollers and which is schematically shown as actuator 16. Furthermore, the actuator 17 may act upon the rounding wedge 13 in order to move it according to the arrow D. All of these actuators or only one of them may be provided or arbitrary combinations are possible.

Figure 3:
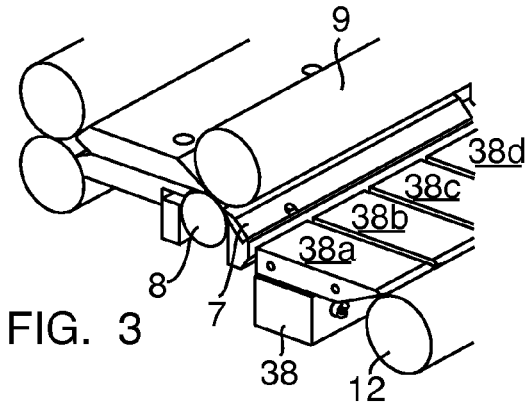
FIG. 3 shows a perspective partial representation of the measurement installation of FIG. 2.
Figure 4:
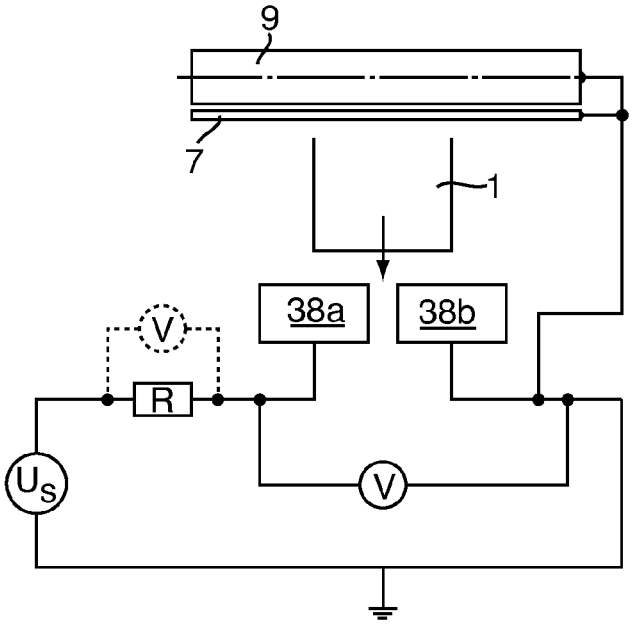
FIG. 4 is a representation of the electrical wiring of the measurement installation of FIG. 2 and FIG. 3.

Preferred embodiments are explained y means of FIGS. 2 to 4. It is shown in the flexer station 50 of FIG. 2 how the metal sheet 1 located inside of it for the pre-treatment reaches the target impact position x on the measurement plate 38. This target impact position is known from the prior art for a given metal sheet material and a given rounding speed in the subsequent rounding station of the rounding machine. If the metal sheet inside of the flexer station 50 reaches the impact position x on the measurement plate 38 during the passage with the intended speed, the adjustment of the flexer station is correct. If the metal sheet impacts too early, for example at the impact position y, as shown with an interrupted line, an element of the flexer station has to be adjusted in order to place the impact position as near as possible to the position x. If the metal sheet 1 impacts too late, at the position y', which is also shown with an interrupted line, an adjustment of an element of the flexer station 50 occurs in the opposite direction. Preferably, the flexer wedge 7 is adjusted, wherein an adjustment in the directions of the arrow B is possible. This may occur manually or by means of the actuator 6. This actuator may be controlled by hand or preferably by the controller 5 of the flexer station, which also can be the controller of the rounding machine. Instead of or additionally to the adjustment of the flexer wedge 7, an adjustment of the flexer roller 9 or 8 and/or of the wedge 20 may take place, which is basically known to the skilled person and which is not explained in more detail here. According to the invention, the impact position of the metal sheet on the measurement plate is determined by means of a measurement installation with a sensor arrangement. This may be an ordinary sensor arrangement which can determine the position of the metal sheet, at which it impacts the measurement plate. Thereby, the sensor arrangement may determine the position for example by means of ultrasonic distance sensors or by means of optical sensors like for example light barriers, or by means of recording an image and image processing.

The determination of the impact position takes place preferably by means of providing an electrical contact of the metal sheet on the measurement plate 38. It is further preferred that the time until the metal sheet impacts the measurement plate, starting from a certain start position, is determined. Knowing the transport speed, the time is a measure for the impact position. The measurement installation has at least one sensor 45, by means of which the arrival of the respective metal sheet 1 at or in the measurement installation can be detected. Particularly, the front edge of the metal sheet in transport direction A is detected, particularly by means of an optical sensor, particularly a light barrier or several light barriers. This detection of the metal sheet 1 starts a time measurement at the time t0 at the measurement installation. It may take place by means of a separate time measurement means or by means of the controller 5 which has been mentioned, and which, is this case, also controls the measurement installation or is part of it and receives the sensor signal of the sensor 45. This option is shown in FIG. 2. The time measurement is ended at the time t1, when the front edge of the metal sheet impacts the measurement plate 38, being signalled to the controller 5 by means of a wire 38'. As evident from FIG. 2 in side view, the time t1 is different, depending on the adjustment of the flexer station and thereby reflects a measure for its adjustment. Thus the time t1 would be shorter if the time measurement would be ended by the impact at the position y or longer if it would be ended by the impact at the position y'. Therefore, the time determined by the measurement installation can be recomputed to yield the location of the impact position because the transport speed of the metal sheet through the flexer station is known. The measurement installation, or in this example the controller 5 respectively, may thereby show the impact position on a display 25, which will be explained in more detail, and if necessary may cause a correcting adjustment of an element of the flexer station by means of at least an actuator of the flexer station, if the measured impact position deviates from the target impact position.

The detection of the impact of the front edge of the metal sheet onto the measurement plate 38 of the measurement installation preferably takes place electrically. This may occur in such a way, that the measurement plate 38 has a first electrical potential and at least one of the rollers 8, 9 have another electrical potential and, if necessary, also the flexer wedge 7 has the potential of the roller. If the front edge of the electrically conductive metal sheet impacts the measurement plate 38, both potentials are being short-circuited, which can be detected by a corresponding current flow or a corresponding voltage drop of the measurement voltage. Thereby, the time measurement is stopped or the time between detection of the front edge by the sensor 45 and the impact of the front edge onto the measurement plate 38 respectively, is determined and thereby the impact position of the metal sheet in the flexer station 50 respectively. In case of coated metal sheets, the electric contact between the rollers 8, 9 and if necessary the flexer wedge 7 and the metal sheet may be insufficient or not present. Because of this, the measurement plate 38 is preferably executed with a plurality of measurement parts 38*a*, 38*b*, 38*c*, 38*d* etc., which are electrically isolated from each other and lie side by side, which alternately also have the different electrical potentials. Thereby, the impact onto the measurement plate 38 can be electrically detected, also by short-circuiting such measurement parts by the front edge of the metal sheet, which is always uncoated. These parts may be formed wedge-shaped, as evident from FIGS. 2 and 3. FIG. 3 shows in graphical view a couple of the measurement wedges lying side by side. FIG. 4 shows a respective measurement circuit with a measurement voltage source US, whereby the rollers 8 or 9 respectively and the flexer wedge 7 have ground potential. The measurement wedges 38*b*, 38*d* etc. have also ground potential (in FIG. 4 only 38*b* is shown for reasons of simplicity). On the contrary, the measurement wedges 38*a*, 38*c* etc. have positive potential (in FIG. 4 only 38*a* is shown). The electrical short circuit possibilities for the measurement voltage by means of the impact of the metal sheet onto the measurement plate 38 are thereby located at the short-circuit measurement wedge-measurement wedge or measurement wedge-flexer wedge or measurement wedge-roller, wherein the measurement voltage drops in a detectable way and therefore stops the time measurement. The detection of the voltage drop is shown in FIG. 4 by means of the voltmeter symbols and may take place in an arbitrary way known by the skilled person by means of the measurement installation or, in this example, particularly by means of the controller 5. The electrical resistance R is chosen to be so high, that the short circuit current remains within a desired boundary.

According to a first embodiment of the invention, the impact position is shown on the optical display 25, which may be a screen or another displaying device. This may for example take place in such a way, that a line is shown, corresponding to the, if necessary shortened, length elongation of the measurement plate, on which a spot which corresponds to the impact position is shown. The operator receives in principle the same information which is available, according to the prior art, by means of freeing the measurement plate and its visual observation after the impact of the metal sheet. Thereby, the operator may then judge if the impact point lies at the desired location or not, and if necessary he can adjust an element of the flexer station manually, particularly the flexer wedge 7. The judgement is simplified if the target impact position x or a permissible range for it is shown as well, such that the operator may correlate the actual impact position, for example y or y', with it in a simple way. In a further variant, a value derived from the measurement signal showing the impact position is displayed, for example a value by which an element of the flexer station has to be manually adjusted in order to get from the actual impact position to the target impact position. In this way, a value of +5 may be displayed when the flexer wedge 7 must be adjusted by 5 units according to a scale located there. The measurement installation, particularly the controller 5 can calculate this derived display value of +5 from the deviation of the measured actual impact position from the target impact position. Instead of a purely manual adjustment, the operator may adjust the flexer element by means of a motor-driven actuator or by means of an actuator, however wherein the actuator is controlled by the operator. Thereby, a display of the adjustment may take place on the display 25 by means of a feedback from the actuator to the controller 5, such that the operator may check if he carries out the adjustment as a reduction of the deviation of the actual impact position to the target impact position in a right way. It is possible to derive the reached pre-rounding from the impact position and to show it as derived value.

According to a further embodiment which may be combined with the described display or may be provided separately therefrom, the adjustment of the flexer element is not carried out manually, but directly by means of the controller 5, via the actuator, depending on the difference between the measured actual impact position and the target impact position. In this way, particularly the flexer wedge 7 may be pivoted upwards by the controller 5 by means of the actuator 6, in order to shift the actual impact position for the next metal sheet from the position y to the position x. The correct adjustment of the flexer wedge may then be verified by means of a further test metal sheet. The controller may furthermore influence the rounding itself by means of the actuators for the elements of the rounding station of the rounding machine.

The method and device are particularly useful when welding can bodies.

While preferred embodiments of the invention are described in the present patent application, it is noted that the invention is not limited to these embodiments but may also be carried out in different ways within the scope of the following claims.

The invention claimed is:

1. A flexer station (50) for the pre-treatment of metal sheets (1, 2) to be rounded in a rounding apparatus (4), wherein in the flexer station a target impact position (x) of a metal sheet on a measurement plate (38) is ascertainable as a reference for the adjustment of at least an adjustable element (20, 9, 7) of the flexer station, and wherein the impact position (y, y') of the metal sheet on the measurement plate is determined by means of a sensor arrangement (45, 38) during the motor-driven passage of the metal sheet through the flexer station, by means of which a signal showing the impact position is provided, by means of which the impact position or a value derived therefrom is representable on a display device (25) and/or by means of which an element of the flexer station determining the pre-treatment of a metal sheet through the latter is adjustable by means of a controller (5) and an actuator in such a way that a deviation from the target impact position in the direction of the passage of the metal sheet is diminished for the subsequent metal sheet.

2. The flexer station according to claim 1, further comprising, in the direction of the passage of the metal sheet, a first element acting upon the metal sheet and a subsequent further element acting upon the metal sheet.

3. The flexer station according to claim 2, wherein at least one of the further element and the first element is adjustable depending on the signal showing the impact position.

4. The flexer station according to claim 1, wherein the impact position is measurable by at least one of electrical, mechanical, optical or acoustical means.

5. The flexer station according to claim 4, wherein the impact position is measured electrically, and wherein during the passage of the metal sheet a time measurement is feasible from a predefined location on, and thereby the time until the metal sheet has electrical contact with a measurement plate (38) is determinable.

6. The flexer station according to claim 5, wherein the measurement plate (38) is divided in multiple measurement parts (38*a*, 38*b*, 38*c*, 38*d*) which lie side by side and are electrically isolated from each other.

7. The flexer station according to claim 2, wherein the first element is one of a wedge, an upper flexer roller or an upper flexer roller, and wherein the subsequent further element acting upon the metal sheet is a flexer wedge.

* * * * *